US005205725A

United States Patent [19]

Pattison

[11] Patent Number: 5,205,725

[45] Date of Patent: Apr. 27, 1993

[54] TOP SUCTION SUMP PUMP HAVING BOTTOM SUCTION IMPELLER

[75] Inventor: Herbert G. Pattison, Fort Wayne, Ind.

[73] Assignee: Wayne/Scott Fetzer Company, Fort Wayne, Ind.

[21] Appl. No.: 730,640

[22] Filed: Jul. 16, 1991

[51] Int. Cl.[5] ..... F04D 29/70

[52] U.S. Cl. ..... 417/423.3; 417/423.14; 415/121.2; 415/206

[58] Field of Search ..... 417/423.15, 423.3, 423.14; 415/182.1, 121.2, 121.3, 206, 203

[56] References Cited

U.S. PATENT DOCUMENTS

| | | | |
|---|---|---|---|
| Re. 24,909 | 12/1960 | Dochterman | 417/457 |
| 2,251,807 | 8/1941 | Ruthman | 417/423.14 |
| 2,514,865 | 7/1950 | Hornschuch | 417/423.14 |
| 2,701,529 | 2/1955 | Finzel | 417/423.3 |
| 2,744,466 | 5/1956 | Difford | 415/121.2 |
| 2,872,084 | 2/1959 | Edwards | 417/423.15 |
| 2,918,016 | 12/1959 | Olson | 417/421 |
| 3,046,900 | 7/1962 | Pollak . | |
| 3,094,936 | 6/1963 | Lightfoot, Jr. | 417/17 |
| 3,115,096 | 12/1963 | Wall | 417/423.15 |
| 3,234,881 | 2/1966 | Ekey | 417/38 |
| 3,352,246 | 11/1967 | Inoue | 417/36 |
| 3,472,168 | 10/1969 | Inoue et al. | 417/17 |
| 3,704,960 | 12/1972 | Zagar | 417/423.14 |
| 3,726,606 | 4/1973 | Peters | 417/40 |
| 3,910,715 | 10/1975 | Yedidiah | 417/423.14 |
| 3,941,507 | 3/1976 | Niedermeyer | 417/40 |
| 3,963,376 | 6/1976 | Miskin | 417/40 |
| 4,215,975 | 8/1980 | Niedermeyer | 417/40 |
| 4,345,879 | 8/1982 | Steiner | 417/40 |
| 4,396,353 | 8/1983 | MacDonald | 417/36 |
| 4,437,811 | 3/1984 | Iwata et al. | 417/40 |
| 4,934,914 | 6/1990 | Kobayashi | 417/423.14 |
| 5,055,000 | 10/1991 | Akhter | 417/423.3 |
| 5,055,006 | 10/1991 | Kobayashi | 417/423.14 |
| 5,061,157 | 10/1991 | Arakawa | 417/423.14 |

FOREIGN PATENT DOCUMENTS

| | | | |
|---|---|---|---|
| 1155337 | 10/1963 | Fed. Rep. of Germany | 417/423.15 |

*Primary Examiner*—Richard A. Bertsch
*Assistant Examiner*—Peter Korytnyk
*Attorney, Agent, or Firm*—George Pappas

[57] ABSTRACT

A submersible sump pump includes a pump housing having a volute chamber in which a centrifugal impeller rotates about a vertical axis. The impeller draws water in axially from below from a fluid passage having a closed bottom, the fluid passage having a plurality of inlets located about the perimeter of the pump housing at an elevation above the level of the outlet from the fluid passage to the volute chamber. Thus, a bottom suction impeller arrangement is provided that prevents debris from the floor of the sump being drawn into the pump.

20 Claims, 2 Drawing Sheets

TOP SUCTION SUMP PUMP HAVING BOTTOM SUCTION IMPELLER

BACKGROUND OF THE INVENTION

1. Field of the Invention

The present invention relates generally to sump pumps, and more particularly to a submersible sump pump having a centrifugal impeller.

2. Description of the Relevant Art

Submersible sump pumps using a motor-driven centrifugal impeller are often constructed in one of two configurations. The first configuration is known as a "bottom suction" pump and the second configuration is known as a "top suction" pump.

In a bottom suction pump, the centrifugal impeller is mounted to the vertical drive shaft of an electric motor for rotation about a vertical axis. The impeller is situated below the motor, with the vanes of the impeller arranged such that rotation of the impeller causes water to be sucked into the impeller axially from below and expelled tangentially and horizontally within a volute chamber. The expelled water is directed by the volute chamber to an outlet to which a lift pipe is attached, such that the water is pumped upwardly through the lift pipe. In the bottom suction arrangement, the bottom of the impeller is often supported by the pump housing very close to the floor of the sump so that the water can be pumped down as low as possible. The pump housing is open below so that the water in the sump can be drawn directly into the impeller from below. Unfortunately, this means that water is drawn into the impeller from immediately adjacent the floor of the sump, which can result in abrasive or clogging debris being drawn into the pump. Examples of a bottom suction type pump are shown in U.S. Pat. Nos. 2,701,529, to H. Finzel; Re. 24,909, to R. W. Dochterman; and 4,345,879, to C. W. Steiner.

In a top suction pump, the centrifugal impeller is mounted to the vertical drive shaft of an electric motor similarly to the mounting arrangement of the bottom suction pump described above, except that the vanes of the impeller are arranged to draw water into the impeller axially from above, rather than from below. The impeller is situated below the motor, which requires that the impeller be spaced from the motor to provide a horizontal path for water intake between the motor and the vanes of the impeller. Since water intake into the impeller is from above, the point at which water is drawn into the pump is elevated somewhat above the floor of the sump, which helps prevent debris from entering. Unfortunately, with the top suction arrangement, any debris which does enter the pump is drawn between the motor and the impeller such that abrasives are directed at the shaft seal which isolates the motor from the pump volute, thereby increasing the wear and hastening the failure of the shaft seal. Any clogging-type debris are also directed at the drive shaft and may become wrapped around it, stalling the motor or impeding the flow of water. Examples of a top suction type pump are shown in U.S. Pat. Nos. 3,234,881, to W. J. Ekey; and 4,396,353, to R. D. MacDonald.

It would be desirable to provide a submersible sump pump which incorporates the advantages of each of the top suction and bottom suction type pumps, while avoiding or alleviating the disadvantages of each. A sump pump constructed in accordance with the present invention fulfills this and other desires.

SUMMARY OF THE INVENTION

In general, the present invention provides a submersible sump pump having a centrifugal impeller of the bottom suction type, wherein water drawn into the bottom of the impeller is taken from a passage whose inlets are elevated above the level of the impeller intake. Thus, the bottom of the impeller is not directly exposed to the floor of the sump, which alleviates the problem of debris intake. The bottom suction arrangement provides a low profile pump that can draw to a desirably low water level, and which avoids direct flow of intake water against the drive shaft seals.

In accordance with a preferred embodiment, the present invention includes a pump housing having a volute-shaped cavity including an axial inlet therebelow and a tangential outlet. A fluid chamber communicates with the axial inlet of the volute-shaped cavity and has a plurality of peripheral inlets communicating exteriorly of the pump housing at an elevation above the axial inlet. A centrifugal impeller is disposed in the volute-shaped cavity for rotation about a substantially vertical axis, and a motor is provided for rotating the centrifugal impeller.

It is an object of the present invention to provide a sump pump that pumps to a low water level without drawing in excessive debris from the floor of the sump.

It is another object of the present invention to provide a sump pump having water inlets elevated above the bottom of the pump housing while utilizing a bottom suction centrifugal impeller.

Additional objects and advantages of the present invention shall be apparent from the following descriptions of a preferred embodiment and from the claims appended hereto.

DESCRIPTION OF THE PREFERRED EMBODIMENT

Figure 1:
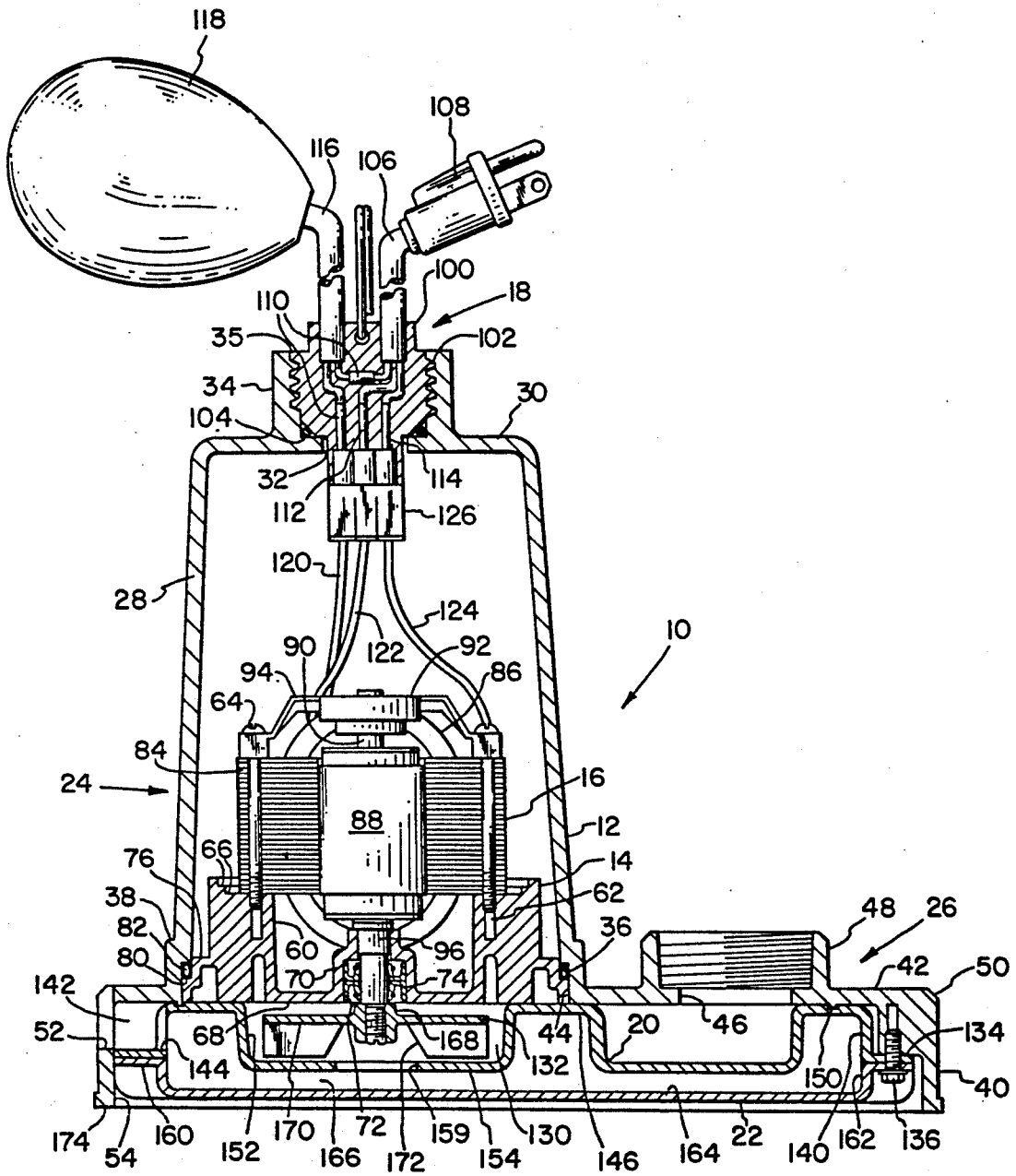
FIG. 1 is a vertical sectional view of a sump pump constructed in accordance With the present invention, taken along vertical section plane 1—1 of FIGS. 2 and 3, and viewed in the direction of the arrows.
Figure 2:
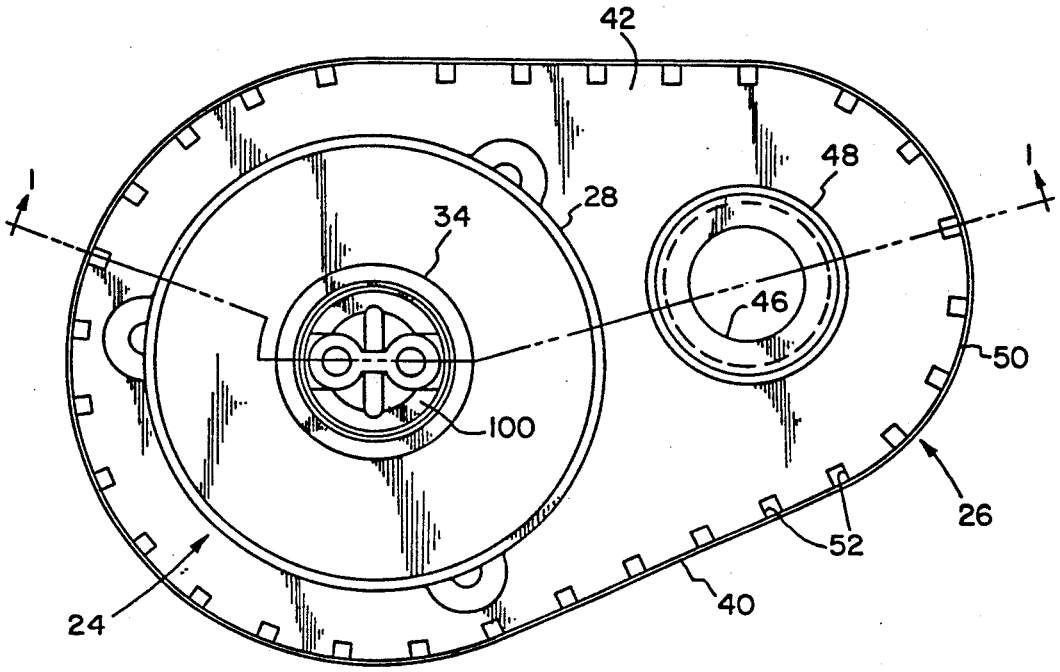
FIG. 2 is a top view of the sump pump of FIG. 1, with the line cord and float switch removed for clarity.
Figure 3:
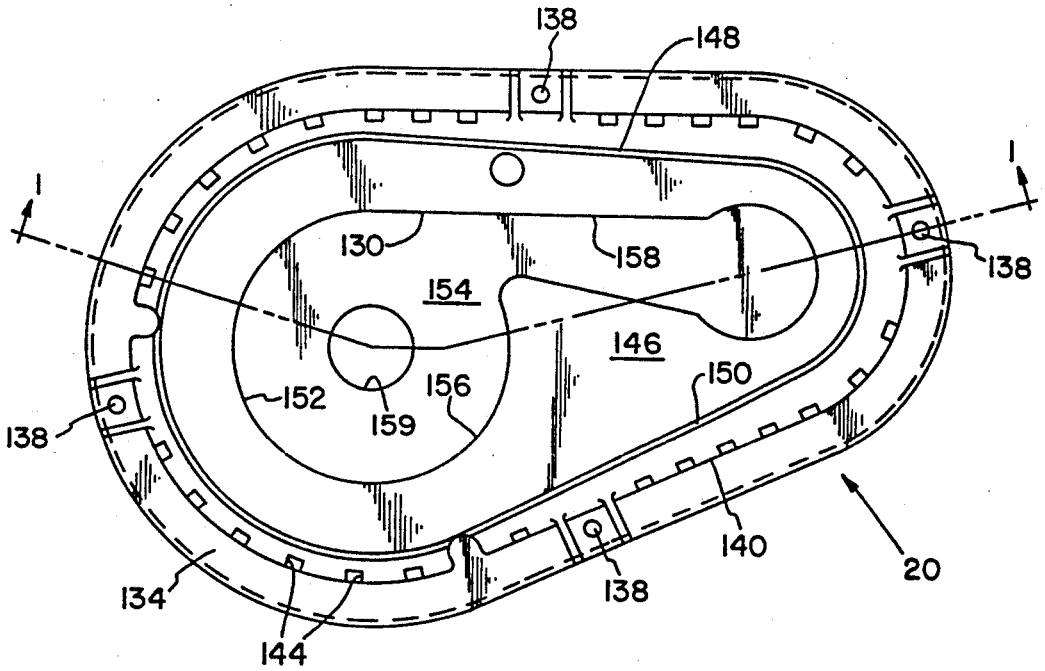
FIG. 3 is a top view of the volute chamber of the sump pump of FIG. 1.

Referring to the drawings, FIGS. 1–3, there is illustrated a submersible sump pump 10 constructed in accordance with the present invention. Sump pump 10 includes as some of its principal components a housing 12, motor mount 14, motor 16, grommet assembly 18, volute member 20, and bottom cover 22.

Housing 12 is integrally constructed in one piece of injection molded plastic and includes an upper, elongate tapered cylindrical motor housing portion 24 and a lower, short oblong pump housing portion 26. Upper motor housing portion 24 includes an upright side wall 28 and a generally horizontal top wall 30 covering motor 16. Top wall 30 has a central aperture 32 therethrough and an upstanding collar 34 surrounding aperture 32 and extending upwardly from top wall 30. The interior surface of collar 34 includes threads 35 for threadedly receiving grommet assembly 18, which is described further below. Near the junction of motor housing portion 24 and pump housing portion 26, sidewall 28 is stepped outwardly in diameter, forming interior ledge 36 and a corresponding external shoulder 38. Lower pump housing portion 26 includes an upstanding perimeter wall 40 and a generally horizontal top wall 42. Top wall 42 includes a pair of circular apertures 44 and 46, the larger aperture 44 being surrounded by sidewall 28 of motor housing portion 24 and conforming in diameter thereto and forming the bottom opening thereof, and the smaller aperture 46 being spaced from sidewall 28 outside motor housing portion 24 and forming the fluid outlet of pump housing portion 26. An upstanding outlet collar 48 surrounds outlet aperture 46 and extends upwardly from top wall 42. A lift pipe (not shown) can be received within outlet collar 48, and a check valve can also be received therein, if desired. Perimeter wall 40 traverses an oblong path, corresponding generally in shape to two tangentially connected circles of different diameters centered on apertures 44 and 46, when viewed in plan, as shown in FIG. 2. The shoulder junction 50 of perimeter wall 40 and top wall 42 is penetrated by a plurality of rectangular inlet openings 52, each of which extends from about the vertical midpoint of perimeter wall 40 to the top surface of top wall 42. Inlet openings 52 are spaced perimetrically more to less evenly around pump housing portion 26, as shown in FIG. 2. Pump housing portion 26, which is integrally molded with motor housing portion 24 to form housing 12, is open at the bottom 54 thereof.

Received within motor housing portion 24 is motor mount 14, which is a one-piece die-cast aluminum mount which serves to mechanically support motor 16 within motor housing portion 24 and which also serves as a heat sink to dissipate heat from motor 16 to the water passing through pump housing portion 26. Motor mount 14 includes a generally upright cylindrical portion 60 having appropriately spaced and sized tapped holes 62 for receipt of hold-down bolts 64 for securing motor 16 to motor mount 14. The top surface of cylindrical portion 60 includes stepped annular recesses 66 for receipt of motor 16, with the stepped recesses of different diameters accommodating motors of different diameters. Cylindrical portion 60 is closed at the bottom end thereof by a bottom wall 68 extending inwardly from cylindrical portion 60 and lying in a substantially horizontal plane. Extending upwardly from bottom wall 68 is a cylindrical collar 70 which surrounds a shaft opening 72 through bottom wall 68. Collar 70 has a first section closest to bottom wall 68 having a diameter large enough to receive motor shaft seals 74 therein. Collar 70 has a second section above the first section that is reduced in diameter sufficiently to serve as a bearing sleeve for a shaft of motor 16 received therethrough. Seals 74 seal between collar 70 and the shaft of motor 16 received therethrough to prevent water in pump housing portion 26 from entering motor housing portion 24 along the shaft of motor 16. Extending horizontally outwardly from cylindrical portion 60 of motor mount 14 is a flange 76 which engages the inner diameter of upright side wall 28 of motor housing portion 24 just above interior ledge 36. A stepped-diameter ring 78 extends downwardly from the perimeter of flange 76 to a level flush with the circular aperture 44 of motor housing portion 24. The stepped diameter forms a ledge 80 which, together with ledge 36 of upright side wall 28, defines therebetween an annular cavity in which an O-ring 82 is received, thereby effecting a water-tight seal between the perimeter of motor mount 14 and motor housing portion 24. In effect, motor mount 14 completely closes circular aperture 44 of motor housing portion 24, except for shaft opening 72 which is itself occluded by shaft seals 74 and the shaft of motor 16 received therethrough.

An electric motor 16 is mounted to motor mount 14 and received within motor housing portion 24. Motor 16 is a "shaded pole" inductance motor comprising field laminations 84, field coils 86, and a rotor 88. An upper rotor shaft 90 is supported by upper bearing 92 held by frame 94 which is secured to laminations 84 by hold-down bolts 64. A lower rotor drive shaft 96 is supported by the upper section of collar 70 of motor mount 14, which serves as both an axial bearing and a sleeve bearing.

Grommet assembly 18 includes an injection molded plastic grommet 100 through which the electrical connections to motor 16 are introduced into motor housing portion 24. Grommet 100 includes exterior threads 102 which correspond to interior threads 35 of upstanding collar 34 of motor housing portion 24. An O-ring 104 is situated between grommet 100 and the interior intersection of top wall 30 and upstanding collar 34, whereby central aperture 32 is occluded and sealed to prevent contamination of the interior of motor housing portion 24 by the external environment. Embedded and hermetically sealed within grommet 100 is a power cord 106 to which a standard electrical power plug 108 is attached. Power cord 106 includes hot wire 110, neutral wire 112, and ground wire 114. Hot wire 110 passes in a loop externally of grommet 100 through float switch cord 116 to float 118. A mercury switch (not illustrated) within float 118 is wired in series with hot wire 110 to make and break the electrical power circuit supplying electric motor 16 as the angular orientation of float 118 changes in response to water level in the sump in which pump 10 is disposed. Each of wires 110, 112 and 114 are electrically connected to conductors 120, 122 and 124 via separable electrical connector 126. Conductors 120, 122 and 124 are electrically connected to electric motor 16.

Volute member 20 is received within pump housing 26 and in cooperation therewith defines a volute chamber 130 in which centrifugal impeller 132 is disposed. Impeller 132 is affixed to the bottom end of drive shaft 96 for rotation therewith about a vertical axis. The perimetrical shape of volute member 20 corresponds generally to that of perimeter wall 40 of pump housing portion 26. A horizontal peripheral flange 134 is secured to pump housing portion 26 by four screws 136 received through holes 138. Volute member 20 includes an outer wall 140 upstanding from flange 134 and spaced inwardly from perimeter wall 40 of pump housing portion 26, such that a perimeter chamber 142 is defined therebetween. Upstanding outer wall 140 includes a plurality of slots 144 therethrough extending the full height of wall 140 from the level of the top surface of flange 134 up to the bottom surface of top wall 42 of pump housing portion 26. Slots 144 are more or less evenly distributed around the perimeter of volute member 20 in somewhat the same fashion as inlet openings 52 are distributed about the perimeter of pump housing portion 26. Extending horizontally inwardly from the top of outer wall 140 of volute member 20 is a top wall 146 which lies flush adjacent the underside of top wall 42 of pump housing portion 26. A groove 148 in the top surface of top wall 146 mates with a corresponding ridge 150 in the bottom surface of top wall 42 to provide a degree of sealing between volute chamber 130 and perimeter chamber 142. Descending from top wall 146 is inner wall 152 which, as viewed from above in FIG. 3, has a volute shaped peripheral configuration and, together with horizontal bottom wall 154, defines volute chamber 130 thereabove. Chamber 130 includes a substantially circular chamber portion 156 in which centrifugal impeller 132 is received and rotates, and a tangential outlet passage 158 which communicates with circular outlet aperture 46 in top wall 42 of pump housing portion 26. An inlet aperture 159 is disposed through bottom wall 154 axially below motor shaft 96 and centrifugal impeller 132.

Covering the underside of volute member 20 is bottom cover 22 having a peripheral horizontal flange 160 which perimetrically engages peripheral flange 134 of volute member 20 such that flanges 134 and 160 are sandwiched together and held by screws 136. Descending from flange 160 is outer wall 162 which is substantially vertically aligned with outer wall 140 of volute member 20. A bottom wall 164 extends horizontally from the lower end of outer wall 162 and completely covers the underside of volute member 20 and is spaced therefrom to define a fluid passage 166 therebetween which communicates exteriorly of pump housing portion 26 about the perimeter thereof via slots 144, perimeter chamber 142, and inlet openings 52. Fluid passage 166 communicates with volute chamber 130 through inlet aperture 159 of volute member 20.

Impeller 132 includes a central hub 168 received on motor shaft 96 and affixed thereto for rotation with shaft 96 by conventional means such as threading or a keyed connection. A solid disk portion 170 extends horizontally from hub 168, and a plurality of blades 172 are integrally molded to the lower side of disk portion 170 and extend generally radially and descend from disk portion 170. This arrangement results in a centrifugal impeller which upon rotation draws water axially upwardly toward hub 168 and directs it radially outwardly below disk 170 and between blades 172.

The lower edges of blades 172 are disposed relatively low in pump housing portion 26 with respect to the bottom edge 174 thereof, with the elevation being only so high as is necessary to permit adequate fluid flow in that portion of fluid passage 166 located below impeller 132 and between volute member 20 and bottom cover 22. This arrangement permits the overall height of sump pump 10 to be minimized, and permits the water in the sump in which sump pump 10 is disposed to be pumped to a desirable low level. Nevertheless, impeller 132 and sump pump 10 in general are protected from debris that may be located on the floor of the sump by bottom cover 22, which prevents the intake of water that is immediately adjacent the sump floor.

In operation, water in the sump in which sump pump 20 is disposed is drawn into pump housing portion 26 all around the perimetrical shoulder 50 thereof through the plurality of inlet openings 52. The water thus drawn in passes into perimeter chamber 142 and from there passes through the plurality of slots 144 into fluid passage 166, and thence axially upwardly through inlet aperture 159 of volute chamber 130. Inlet aperture 159 can also be characterized as an outlet opening of fluid passage 166. Impeller 132 directs the water horizontally through tangential outlet passage 158 and thence upwardly through aperture 46.

It should be appreciated that inlet openings 52 in outer wall 40 of pump housing portion 26 provide an initial screening function to prevent undesirable solid debris from entering sump pump 10. Because the sum of the inlet cross sectional area of inlet openings 52 is distributed over the entire periphery of pump housing portion 26, the flow velocity through any one of the inlet openings 52 is relatively low, which helps to prevent debris from being dislodged from the floor of the sump. In addition, only solid particles which are smaller than each inlet aperture 52 are capable of entering sump pump 10. Furthermore, the lower extent of each inlet aperture 52 is disposed at an elevation that is level with or somewhat above a horizontal plane passing through inlet aperture 159. Thus, the level of inlet openings 52 is above the level of the outlet of fluid passage 166. This arrangement elevates the intake level of sump pump 10 above the floor of the sump, which helps prevent debris on the floor from being sucked in, while not diminishing the lowest level to which sump pump 10 is capable of pumping water.

Thus, the sump pump 10 constructed in accordance with the present invention provides the advantage of a "top suction" pump by including intake ports elevated above the floor of the sump, and the advantages of a "bottom suction" pump by having the water introduced to the centrifugal impeller axially from below. The former advantage helps to prevent intake of debris, and the latter advantage allows the pump to draw to a low water level and prevents intake water from flowing directly past the motor shaft and seals, saving wear on the seals and alleviating clogging due to debris becoming wrapped around the motor shaft.

While the present invention has been particularly described in terms of a preferred embodiment, it should be understood that no limitation of the scope of the invention is intended thereby, and that the scope of the invention includes variations, uses or adaptations of the invention following the general principles thereof, including such departures from the present disclosure as come within known or customary practice in the art to which this invention pertains, limited only by the claims appended hereto.

What is claimed is:

1. A sump pump for pumping a standing fluid comprising:

a pump housing defining a volute chamber;

a centrifugal impeller mounted within said volute chamber for rotation about a substantially vertical axis;

an electric motor having a substantially vertical driven shaft extending into said volute chamber in driving engagement with said centrifugal impeller;

said pump housing further defining a fluid chamber having an outlet opening communicating with said volute chamber axially below said centrifugal impeller, and a plurality of inlet openings for receiving standing fluid therethrough, said inlet openings located on said pump housing and communicating exteriorly of said pump housing entirely above a horizontal plane passing through said outlet opening of said fluid chamber.

2. The sump pump of claim 1, in which said pump housing includes a perimeter wall and a top wall, and further includes a volute member and a bottom cover, said volute chamber being defined between said volute member and said top wall, and said fluid chamber being defined between said volute member and said bottom cover.

3. The sump pump of claim 2, in which said volute member includes a plurality of openings therethrough communicating said fluid chamber with said plurality of inlet openings of said pump housing, and an opening therethrough comprising said outlet opening of said fluid chamber.

4. The sump pump of claim 3, in which said bottom cover is impervious and prevents communication of said fluid chamber exteriorly of said pump housing therebelow.

5. The sump pump of claim 4, in which said volute member defines a volute-shaped cavity surrounding said impeller to the sides and therebelow and comprising said volute chamber, said volute chamber further including a tangential outlet passage, and in which said pump housing includes an outlet aperture in the top wall thereof communicating with said tangential outlet passage.

6. The sump pump of claim 5, in which said plurality of openings of said volute member and said plurality of inlet openings of said pump housing are distributed substantially evenly about the respective perimeters of said pump housing and said volute member.

7. The sump pump of claim 5, in which said volute member includes a substantially horizontal peripheral flange connected to said pump housing, a perimeter wall upstanding from said peripheral flange and spaced inwardly from said perimeter wall of said pump housing, a top wall extending horizontally from said perimeter wall of said volute member, an inner wall descending from said top wall of said volute member and delimiting said volute chamber and said tangential outlet passage sideways, and a bottom wall extending horizontally from said inner wall and delimiting said volute chamber and said tangential outlet passage below, said outlet opening of said fluid chamber being disposed through said bottom wall of said volute member.

8. The sump pump of claim 7, and further including a motor housing extending upwardly from said pump housing and surrounding said motor above and sideways.

9. The sump pump of claim 8, in which said pump housing includes an aperture in said top wall thereof communicating with the interior of said motor housing, said aperture being occluded by a motor mount spanning said aperture.

10. The sump pump of claim 9, in which said motor mount supports said motor thereabove.

11. A sump pump for pumping a standing fluid comprising:

a pump housing including a volute-shaped chamber having an axial inlet therebelow and a tangential outlet, and a fluid chamber having a plurality of peripheral inlets for receiving standing fluid therethrough, said peripheral inlets located on said pump housing and communicating exteriorly of said pump housing at an elevation entirely above said axial inlet, said fluid chamber communicating with said axial inlet of said volute-shaped chamber;

a centrifugal impeller disposed in said volute-shaped chamber for rotation about a substantially vertical axis; and motor means for rotating said centrifugal impeller.

12. The sump pump of claim 11, in which said pump housing includes a perimeter wall and a top wall, and further includes a volute member and a bottom cover, said volute-shaped chamber being defined between said volute member and said top wall, and said fluid chamber being defined between said volute member and said bottom cover.

13. The sump pump of claim 12, in which said volute member defines said volute-shaped chamber surrounding said impeller to the sides and therebelow, said volute-shaped chamber including a tangential outlet passage, and in which said pump housing includes an outlet aperture in the top wall thereof communicating with said tangential outlet passage.

14. The sump pump of claim 13, in which said volute member includes a substantially horizontal peripheral flange connected to said pump housing, a perimeter wall upstanding from said peripheral flange and spaced inwardly from said perimeter wall of said pump housing, a top wall extending horizontally from said perimeter wall of said volute member, an inner wall descending from said top wall of said volute member and delimiting said volute-shaped chamber and said tangential outlet passage sideways, and a bottom wall extending horizontally from said inner wall and delimiting said volute-shaped chamber and said tangential outlet passage below, said outlet opening of said fluid chamber being disposed through said bottom wall of said volute member.

15. The sump pump of claim 14, and further including a motor housing extending upwardly from said pump housing and surrounding said motor above and sideways.

16. The sump pump of claim 15, in which said pump housing includes an aperture in said top wall thereof communicating with the interior of said motor housing, said aperture being occluded by a motor mount spanning said aperture.

17. The sump pump of claim 16, in which said volute member includes a plurality of openings therethrough and said pump housing includes a plurality of openings therethrough comprising said plurality of peripheral inlets communicating said fluid chamber exteriorly of said pump housing.

18. The sump pump of claim 17, in which said bottom cover is impervious and prevents communication of said fluid chamber exteriorly of said pump housing therebelow.

19. The sump pump of claim 18, in which said plurality of openings of said volute member and said plurality of peripheral inlet openings of said pump housing are distributed substantially evenly about the respective perimeters of said pump housing and said volute member.

20. The sump pump of claim 19, in which said motor mount supports said motor thereabove.

* * * * *